United States Patent [19]

Oker

[11] Patent Number: 4,599,928

[45] Date of Patent: Jul. 15, 1986

[54] APPARATUS FOR FORMING CUBES FROM A PRODUCT SUCH AS A LOAF OF CHEESE

[75] Inventor: Thomas W. Oker, Cincinnati, Ohio

[73] Assignee: Tom Oker Sales & Mfg., Inc., Cincinnati, Ohio

[21] Appl. No.: 721,766

[22] Filed: Apr. 10, 1985

[51] Int. Cl.[4] ..... B26D 1/547

[52] U.S. Cl. ..... 83/581.1; 83/651.1; 83/751; 83/926 B

[58] Field of Search ..... 83/651.1, 582, 751, 83/581.1, 926 B

[56] References Cited

U.S. PATENT DOCUMENTS

| | | | |
|---|---|---|---|
| 872,422 | 12/1907 | Hodell | 83/651.1 |
| 1,288,702 | 12/1918 | Selvig | 83/651.1 X |
| 1,379,724 | 5/1921 | Russell . | |
| 2,073,257 | 3/1937 | Van Riper | 83/651.1 X |
| 2,437,123 | 3/1948 | Petskeyes | 83/751 |
| 2,472,699 | 6/1949 | Gangemi | 83/651.1 |
| 2,692,430 | 10/1954 | Kraft et al. . | |

*Primary Examiner*—Donald R. Schran

*Attorney, Agent, or Firm*—Wood, Herron & Evans

[57] ABSTRACT

Apparatus for forming cubes from a product such as a loaf of cheese. The apparatus has a base and a block mounted on the base, the block having intersecting, transverse and longitudinal grooves in its upper surface. A pair of bows are pivotally mounted perpendicularly to each other on said base. The bows have a plurality of spaced wires which cooperate with the grooves to pass through the product and into the grooves in order to form cubes.

8 Claims, 6 Drawing Figures

APPARATUS FOR FORMING CUBES FROM A PRODUCT SUCH AS A LOAF OF CHEESE

This invention relates to apparatus for slicing products such as cheese, and is particularly directed to apparatus for forming cubes from a loaf of cheese.

While the invention has application to other products, it is particularly directed to the forming of cubes from a two and one-half pound loaf of cheese because cheese is such an excellent nutritional food which could enjoy far greater consumption if it could easily be formed into cubes.

Cheese is normally sold to retail outlets in the form of a five-pound loaf which measures $10\frac{1}{2}\times3\frac{1}{2}\times3\frac{1}{2}$. To eat the cheese, it must be cut into thin slices or, alternatively, into cubes. Cheese is widely sold in individually wrapped slices, but it is relatively difficult to sell cheese cubes in the same manner.

Under programs of the U.S. Government, it is possible for schools to obtain cheese at no cost. Cheese is not widely used in schools because of the considerable amount of labor required to cut a loaf into edible sizes such as cubes.

Until the present invention, there has been on the market no relatively inexpensive, easy-to-use, apparatus for converting a loaf of cheese into cubes. Such apparatus, with a capability of enormously reducing the labor required to form cubes, would be a boon to schools, caterers preparing appetizers, food stores who could sell cubed cheese for party use, hospitals and the like.

The problem of forming cheese into cubes derives from the fact that the loaf of cheese is firm and tacky. Hence, it is difficult to pass a cutting device such as a knife through it. Further, the cheese will tend to crush at the end of a stroke of a knife through it. Tacky crumbs are formed which stick to the cutting device and harden.

An objective of the present invention has been to provide apparatus for forming cubes from a cheese loaf or other products, the apparatus eliminating the disadvantages referred to above, the apparatus further achieving the attributes of greatly reducing the labor involved in forming cheese cubes; being inexpensive to manufacture; being easy to clean or to disassemble and to clean; and cutting the cheese without crushing.

This objective of the invention is attained through the apparatus of the present invention which is formed primarily of four easily manufactured and assembled elements; namely, a base, a block fixedly mounted to the base and two bows each carrying stretched wires which are capable of being passed through the product (cheese) mounted on the block and into transverse and longitudinal grooves formed in the surface of the block. With this apparatus, cheese is cubed as follows: the five pound loaf is cut in half so that it is $5\frac{1}{4}$ inches long. That loaf is placed on the block. A lower bow is first passed through the cheese to form slabs. The loaf is rotated 90°. The lower bow is again passed through the loaf to form sticks. Then the upper bow is passed through the loaf to form cubes.

Apparatus for forming these functions is disclosed generally in U.S. Pat. No. 1,379,724. The present invention has a number of features which distinguish it from prior art devices and impart to the apparatus minimal cost, ease of assembly, cleanability and the capability of formation of cubes without crushing.

The base is formed of a single sheet metal member having a horizontal plate and downwardly-depending flanges which support the plate slightly above the surface on which it is positioned. The corners formed by the downwardly-depending flanges are beveled so as to eliminate food-catching corners and permit the base to be easily cleaned free of cheese crumbs.

A plastic block is secured to the base by two removable nuts engaging the undersurface of the plate, the nuts being spaced above the supporting surface by the downwardly-depending flanges of the plate.

The block has deep, longitudinal grooves to receive the lower bow wires and shallow, transverse grooves to receive the upper bow wires. The lower ends of the grooves are radiused to eliminate food-collecting corners.

Posts are mounted on the block by removable nuts opposite the pivot axes of the bows, the posts keeping the product from sliding with respect to the block as the bows pass through the product.

The base plate has two pairs of upstanding ears struck from it for mounting each of the bows. A single wire rod passing through the ears and holes in the bows serves to attach each of the bows to the plate.

Each bow is formed as a rugged metal casting presenting a pair of spaced right-angle mounting legs at one end, a rectangular frame in the central portion of the bow and a U-shaped handle at the opposite end of the bow. The lower bow has shorter mounting legs than the upper bow so that the upper bow can lie on top of the lower bow at the conclusion of the slicing operation while the axes of the bows lie in the same plane. The lower bow has projecting feet at the end remote from the pivot axis, the feet engaging the plate and determining the downward extent of the pivotal movement of the lower bow. The rectangular frame of the upper bow engages the rectangular frame of the lower bow to determine the extent of the downward pivotal movement of the upper bow.

With respect to each bow, one end of the rectangular frame is formed with a plurality of spaced shouldered holes. Compression springs are inserted into the holes and rest against the shoulders. Headed studs are inserted into the holes with the heads engaging the springs. Each stud has a shank portion which projects through the hole, the shank having a transverse slot which receives a loop in the cutting wire to fasten the cutting wire to one end of the frame. The other end of the cutting wire is looped and is slid around headed pins which are mounted at the opposite end of the rectangular frame. The spring-loaded studs perform two functions. First, in the operation of the bow, they permit the cutting wires to flex slightly in passing through the cheese and in the flexing present a curved surface which tends to eliminate the crushing of the cheese at the end of the stroke. Second, the spring-loaded studs may be pushed through the holes in which they are located in order to permit a cutting wire to be removed from the stud and conveniently replaced.

Finally, the loops in the cutting wires which are attached to the studs are formed with a flat end suitable for engagement with the flat bottom of the slot in the studs.

The several objectives and features of the invention will become more readily apparent from the following detailed description taken in conjunction with the accompanying drawings in which.

Figure 1:
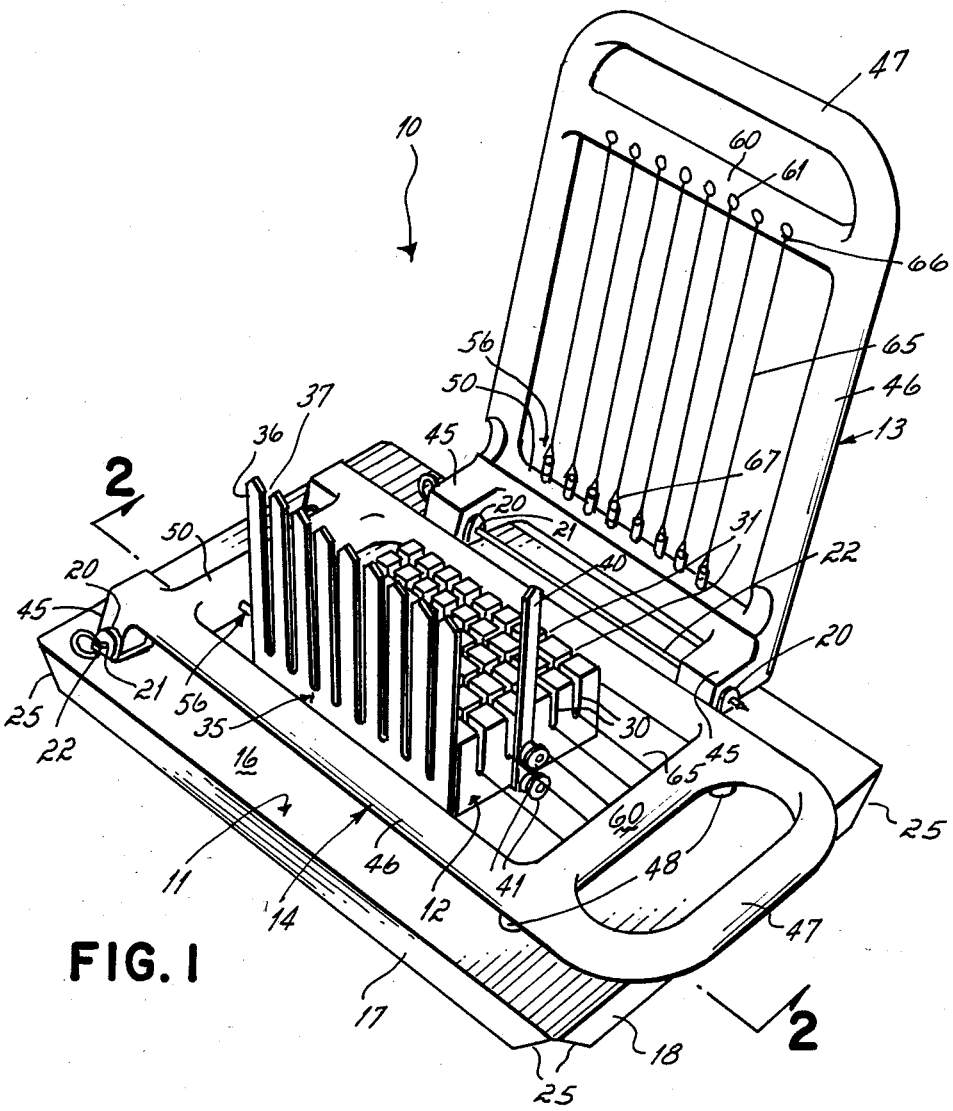
FIG. 1 is a perspective view of the apparatus in accordance with the present invention.
Figure 2:
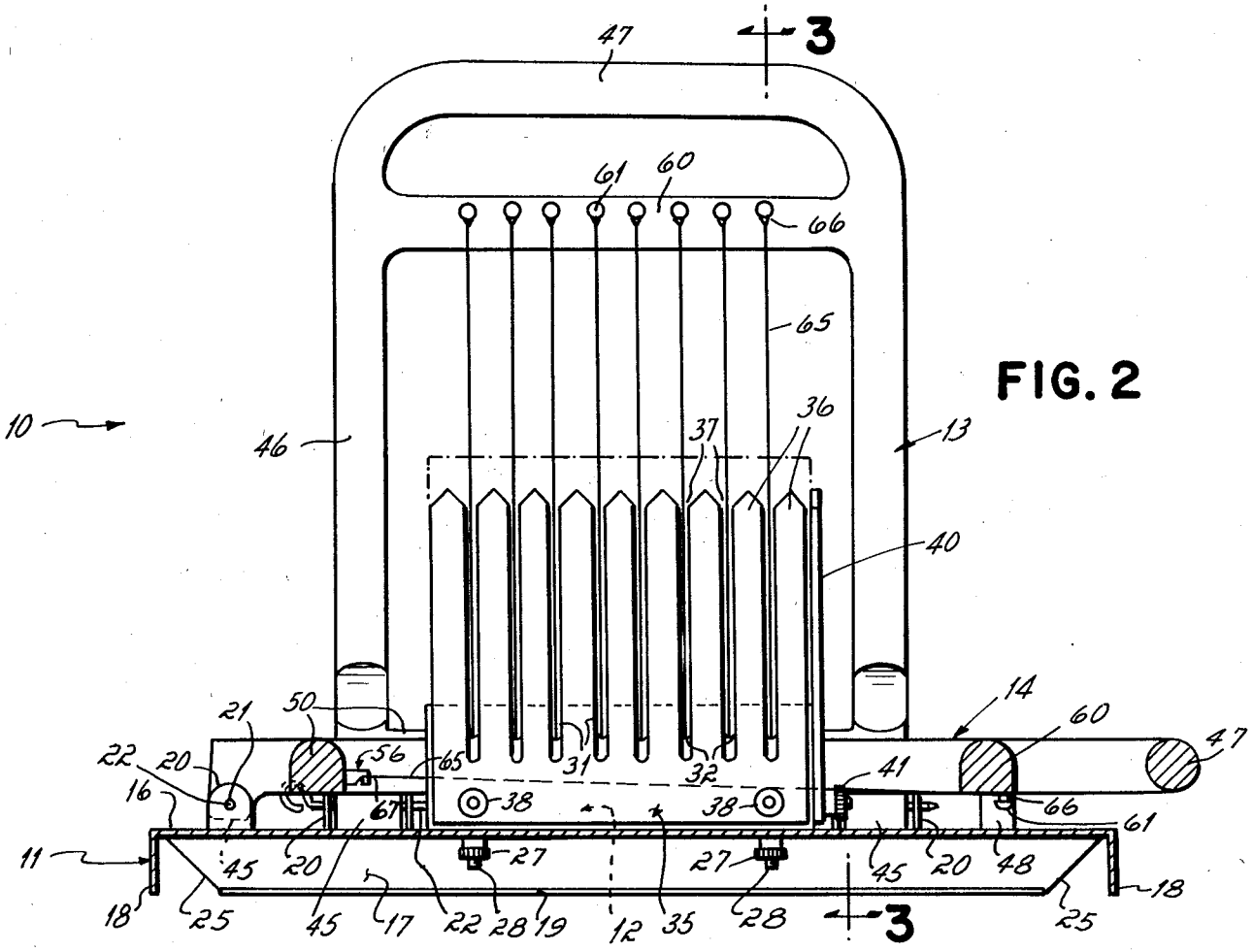
FIG. 2 is a cross-sectional view taken along lines 2—2 of FIG. 1 showing a first step of forming the cubes.

Referring to FIG. 1, there is shown a cheese cubing apparatus 10 having a base 11, a block 12 mounted on the base and upper and lower bows 13 and 14 formed of aluminum sand castings. The base 11 is formed of a stainless steel member having a flat, horizontal plate 16 and downwardly-depending flanges 17 and 18, the flanges being inwardly-turned as at 19 to provide surfaces which engage the surface on which the apparatus is to be mounted. The plate has two pairs of ears 20 struck upwardly from its surface, the ears being provided with holes 21 through which a stainless rod 22 can pass to mount the bows 13 and 14 to the base. The holes in the ears preferably have an I.D. slightly less than the O.D. of the rod so that the rod is press-fitted through the holes and thereby frictionally retained in the ears.

The depending flanges 17 and 18 are beveled as at 25 at each corner of the base so as to open the corners and thus eliminate sharp food-catching corners thereby permitting cleaning fluid to pass freely out of the bottom of the base.

The block 12, made of polyethylene, is mounted on the base by a pair of removable nuts 27 which are secured to threaded bolts 28 which are threaded into the block. The block has, in its upper surface, a plurality of spaced parallel, longitudinal, deep grooves 30. Intersecting the deep grooves 30 are a plurality of transverse parallel spaced, shallow grooves 31. Each groove has a radius at its bottom as at 32 to eliminate food-catching corners. The longitudinal, transverse grooves can be cleaned by an elongated, thin brush.

Along the longitudinal side of the block remote from the pivot axis of the upper bow is a plate 35 having a plurality of upwardly-extending posts 36. The posts are spaced from each other by slots 37 which are aligned with the transverse grooves 31 in the block. The plate 35 is mounted to the block by removable nuts 38.

A single post 40 is mounted on the transverse side of the block opposite the pivot axis of the lower bow 14 by removable nuts 41. The posts prevent the product from sliding with respect to the upper surface of the block 12 during the cutting process. A plate similar to plate 35 could be substituted for the single post 41, although it is not necessary. The single post is sufficient because the lower bow makes the first two passes through the cheese when it is in either loaf form during the first pass or slab form during the second pass. Plural posts are preferred opposite the upper bow, for it is during the pass of the upper bow that the cubes are formed and the plural posts provide resistance to the movement of the thus formed cubes. The posts could be molded integrally with the block.

Each bow has right-angle legs 45 at one end, an intermediate frame 46 and a U-shaped handle 47 at the opposite end. The legs of the lower bow are shorter than the legs of the upper bow by approximately the thickness of the frame so that the upper bow can lie horizontally on top of the lower bow at the conclusion of the cubing operation. The legs are formed with holes through which the rods 22 pass to pivotally mount the bows to the ears 20.

The end of the lower bow remote from the pivot axis has feet 48 which are engageable with the upper surface of the base to determine the final horizontal position of the lower bow. The frame 46 of the upper bow lies on top of the frame 46 of the lower bow to determine the extent of downward movement of the upper bow.

Figure 6:
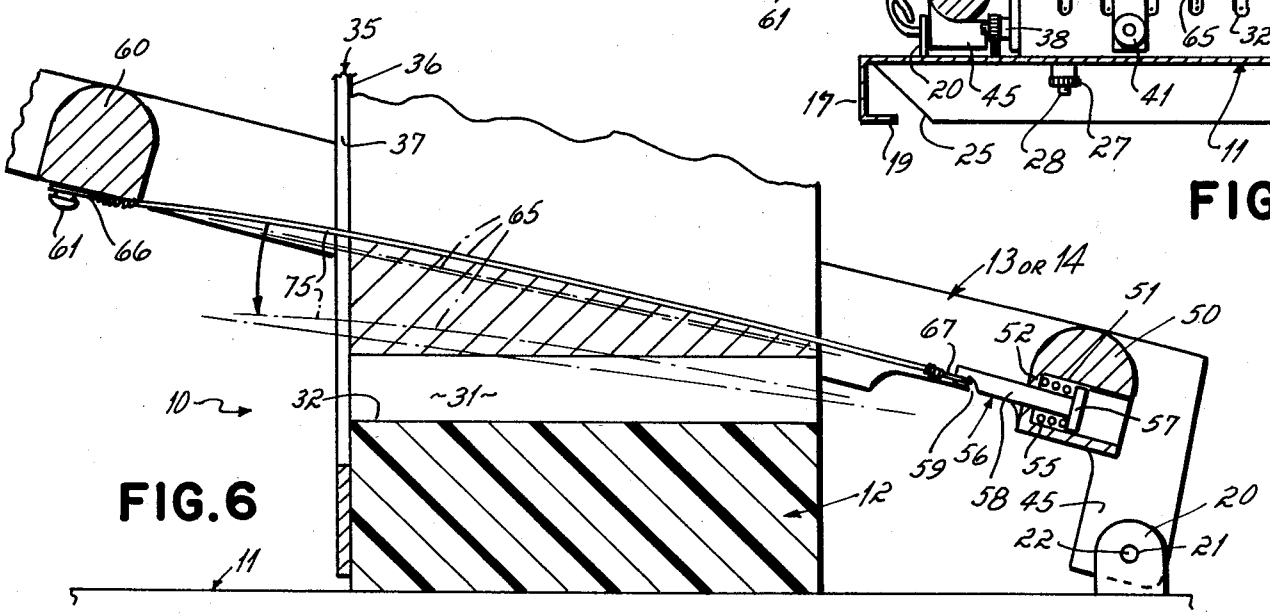
FIG. 6 is a fragmentary cross-sectional view illustrating the flexure of the cutting wires as they are passing through the cheese.

As best shown in FIG. 6, each frame 46 has a lower crossbar 50 through which a plurality of bores 51 are formed, each bore having a shoulder 52 (FIG. 6). A compression spring 55 is inserted in each bore 51. A stud 56 having a head 57 passes through each bore with the head engaging the compression spring. The stud has a shank 58 projecting through the bore 51, the end of which has a transverse, diagonal slot 59.

The opposite end of each frame has a transverse bar 60 to which are mounted a plurality of headed pins 61, each pin 61 being opposite a respective stud 56.

A steel cutting wire 65 has a loop 66 at one end which passes around the pin 61 and a loop 67 at the other end which is inserted into the slot 59 of the stud 56. The loop 67 is formed with a flat end to engage the flat surface of the slot 59.

Figures 3, 4:
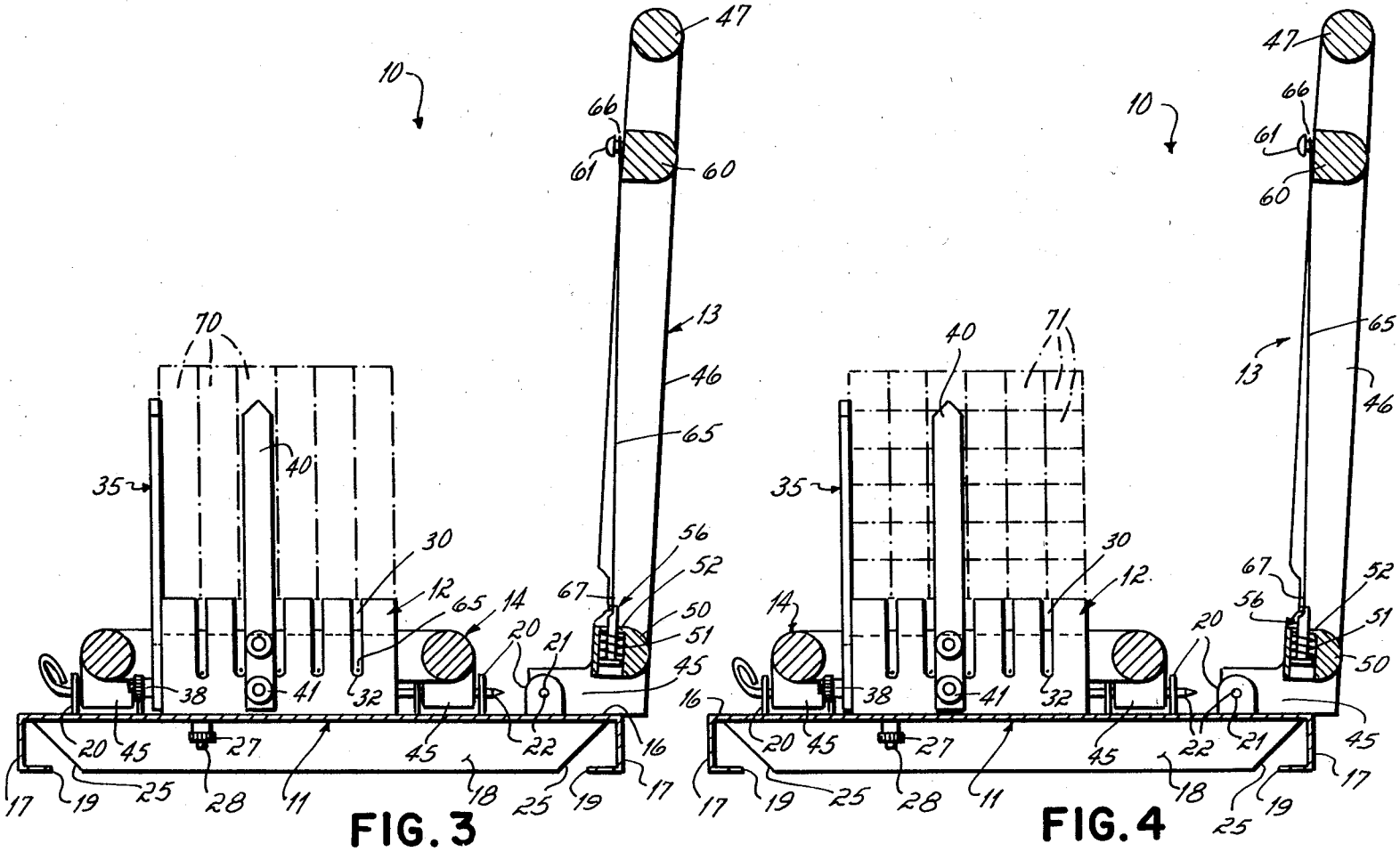
FIG. 3 is a cross-sectional view taken along lines 3—3 of FIG. 2 showing a second step in forming the cubes.
FIG. 4 is a view similar to that of FIG. 3 showing a third step in forming the cubes.
Figure 5:
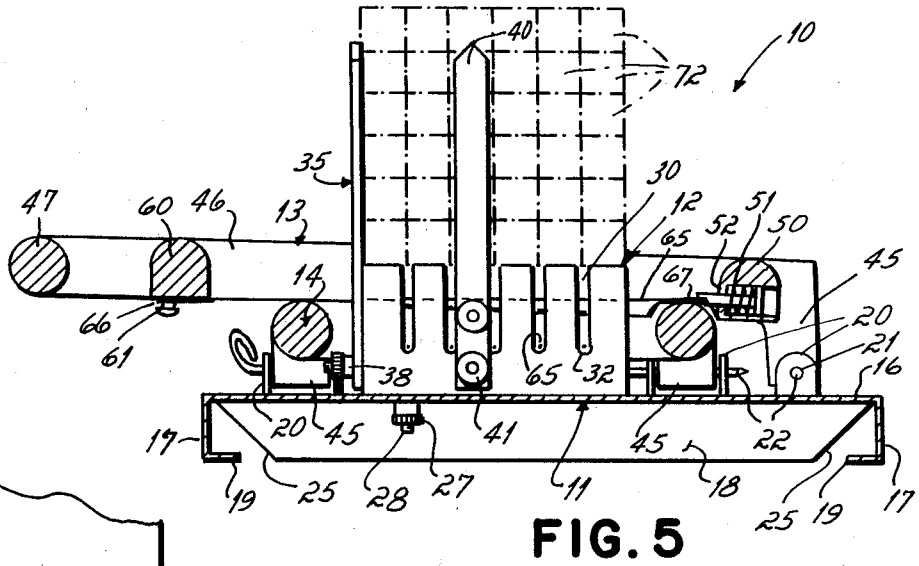
FIG. 5 is a view similar to that of FIG. 4 showing the final step in forming the cubes.

In the operation of the invention, a loaf of cheese, or other product, is placed on the upper surface of the block 12 with side surfaces abutting the posts 36 and 40, as shown in FIGS. 2 through 5. The lower bow 14 is first passed through the cheese to form slabs, as shown at 70 in FIG. 3. The cheese is rotated through 90° so that the slabs lie in a horizontal attitude parallel to the upper surface of the block 12. The lower bow is then passed through the loaf, thereby cutting the slab into sticks 71, as shown in FIG. 4. Finally, the upper bow is passed through the loaf to cut the sticks into cubes 72, as shown in FIG. 5. Obviously, if it is desired to have sticks only, these can be formed simply by cutting with the lower bow followed by a cutting with the upper bow.

As the bow passes through the cheese, as depicted in FIG. 6, each wire tends to flex into an arcuate shape as shown at 75 in FIG. 6 due to the compressing of springs 55. In taking this shape, the wire avoids crushing the cheese at the lower surface thereof as the bow completes its pass through the cheese.

If a cutting wire 65 is to be replaced, the operation is quite simple. A screwdriver or other tool is placed against the head 57 of the stud 56 through the bore 51 to compress the spring. With the spring compressed the wire can be easily removed. Similarly, the wires can be easily assembled to the bow by compressing the spring and looping the ends of the wire over the pin 61 into the slot 59, respectively.

From the above disclosure of the general principles of the present invention and the preceding detailed description of a preferred embodiment, those skilled in the art will readily comprehend the various modifications to which the present invention is susceptible. Therefore, we desired to be limited only by the scope of the following claims and equivalents thereof.

Having described my invention, I claim:

1. Apparatus for forming cubes from a product comprising;

a base;

a block mounted on said base and having a plurality of spaced parallel grooves in the upper surface thereof in a longitudinal direction and intersecting spaced parallel grooves in a transverse direction;

a lower bow pivotally mounted on said base;

an upper bow pivotally mounted on said base on an axis perpendicular to the axis of said lower bow;

each said bow having a frame creating an opening through which said block passes when said bow is swung to a horizontal position parallel to said base;

each said bow having a plurality of cutting wires stretching across said opening and aligned with respective grooves in said block;

each said wire having a loop at each end;

each said frame having a plurality of spaced studs projecting from one end of said frame, each said stud receiving a loop from one end of a respective cutting wire;

each said frame having a plurality of shouldered bores in the other end of said frame opposite respective lugs;

a headed pin located in each said bore and having a slotted shank projecting through said bore to receive a loop from the other end of each said wire;

and a compression spring disposed in each said bore between a shoulder and the head of a pin to apply tension to said wire.

2. Apparatus as in claim 1 in which said base is a rectangular sheet metal member having a flat, horizontal section and having depending flanges along its four sides to provide support for said base;

said base having four pairs of ears struck upwardly from said flat horizontal section, said ears forming pivot supports for said bows;

and a rod for each bow extending through said ears and holes in said bows to pivotally mount said bows to said base.

3. Apparatus as in claim 1 in which said base is a rectangular sheet metal member having depending flanges along its four sides to provide support for said base;

each said flange being beveled at its ends to create openings at each of the corners of said base.

4. Apparatus as in claim 1 further comprising:

a plurality of posts projecting upwardly from said block along edges of said block remote from the pivot axes of said bows, said posts resisting sliding movement of said product with respect to said block.

5. Apparatus as in claim 4 in which said posts opposite said upper bow consist of a plate having upwardly-projecting posts for each of the positions on said block defined by said transverse grooves.

6. Apparatus as in claim 1 in which the bottoms of said grooves are radiused to facilitate cleaning of said block.

7. Apparatus for forming cubes from a product comprising;

a rectangular base formed of sheet metal presenting a flat plate with depending support flanges, said flanges being beveled at said corners to provide openings at the corners of said base;

a block having a plurality of spaced parallel grooves in the upper surface thereof in a longitudinal direction and intersecting spaced parallel grooves in a transverse direction, said block being secured to said flat plate, four pairs of ears struck upwardly from said flat plate;

a lower bow pivotally mounted on said base between two pairs of ears;

an upper bow pivotally mounted on said base on an axis perpendicular to the axis of said lower bow between the remaining two pairs of ears;

each said bow having a frame creating an opening through which said block passes when said bow is swung to a horizontal position parallel to said base;

each said bow having a plurality of cutting wires stretching across said opening and aligned with respective grooves in said block.

8. Apparatus for forming cubes from a product comprising;

a base;

a block mounted on said base and having a plurality of spaced parallel, deep grooves in the upper surface thereof in a longitudinal direction and intersecting spaced parallel, shallow grooves in a transverse direction;

a lower bow pivotally mounted on said base by short right-angle legs for movement in a longitudinal direction;

an upper bow pivotally mounted on said base by long, right-angle legs on an axis perpendicular to the axis of said lower bow for movement in a transverse direction;

said lower bow having feet opposite said legs for engagement with said base to determine the movement of said bow through said block;

said upper bow being engageable with said lower bow to determine the extent of movement through said block;

each said bow having a frame creating an opening through which said block passes when said bow is swung to a horizontal position parallel to said base;

each said bow having a plurality of cutting wires stretching across said opening and aligned with respective grooves in said block;

each said wire having a loop at each end;

each said frame having a plurality of spaced studs projecting from one end of said frame, each said stud receiving a loop from one end of a respective cutting wire;

each said frame having a plurality of shouldered bores in the other end of said frame opposite respective lugs;

a headed pin located in each said bore and having a slotted shank projecting through said bore to receive a loop from the other end of each said wire;

and a compression spring disposed in each said bore between a shoulder and the head of a pin to apply tension to said wire.

* * * * *